US006619562B2

(12) United States Patent
Hamaguchi et al.

(10) Patent No.: US 6,619,562 B2
(45) Date of Patent: Sep. 16, 2003

(54) ULTRASONIC ATOMIZER ALLOWING STATES OF OPERATION TO BE READILY DISTINGUISHED

(75) Inventors: Takehiro Hamaguchi, Kyoto (JP); Norihito Nishizawa, Toba (JP); Susumu Minamikawa, Kyoto (JP)

(73) Assignee: Omron Corporaton, Kyoto (JP)

( * ) Notice: Subject to any disclaimer, the term of this patent is extended or adjusted under 35 U.S.C. 154(b) by 140 days.

(21) Appl. No.: 09/880,831

(22) Filed: Jun. 15, 2001

(65) Prior Publication Data

US 2001/0052552 A1 Dec. 20, 2001

(30) Foreign Application Priority Data

Jun. 16, 2000 (JP) ..... 2000-181047

(51) Int. Cl.[7] ..... B05B 3/04

(52) U.S. Cl. ..... 239/102.1; 239/67; 239/70; 239/71; 239/338

(58) Field of Search ..... 239/102.1, 67, 239/70, 71, 338

(56) References Cited

U.S. PATENT DOCUMENTS 4,352,248 A * 10/1982 Kobayashi ..... 34/88
5,452,711 A * 9/1995 Gault ..... 128/200.14
5,551,416 A 9/1996 Stimpson et al.
5,825,975 A 10/1998 Privas
5,881,716 A 3/1999 Wirch et al.
6,442,236 B1 * 8/2002 Utaka ..... 378/84

FOREIGN PATENT DOCUMENTS

EP 0 933 138 8/1999

* cited by examiner

*Primary Examiner*—Robin O. Evans
(74) *Attorney, Agent, or Firm*—Morrison & Foerster LLP

(57) ABSTRACT

There is provided an ultrasonic atomizer having a start/stop switch and when the switch is turned on (ST1) an oscillation frequency generation unit and an air feeding motor are operated (ST2), an air volume dial is checked and a decision is made as to whether the current mode is a continuous mode or a timer mode (ST3, ST7). If it is the continuous mode a state of operation is displayed by dynamically moving a segment on a display and periodically ringing a buzzer to notify the user accordingly (ST4, ST5). The start/stop switch is turned off, an oscillation unit is stopped and an oscillator is turned off (ST10, ST11), and the air feeding motor is also stopped (ST12). If this state is provided in the continuous mode then an inactive state is indicated by static characters "00" (ST14). This ensures that the user can determine whether the ultrasonic atomizer in the continuous mode currently has the active state or the inactive state.

7 Claims, 7 Drawing Sheets

ULTRASONIC ATOMIZER ALLOWING STATES OF OPERATION TO BE READILY DISTINGUISHED

BACKGROUND OF THE INVENTION

1. Field of the Invention

The present invention relates to atomizers such as ultrasonic inhalers having an oscillator incorporated in the main body and oscillating to atomize liquid.

2. Description of the Related Art

A conventionally well known, ultrasonic atomizer uses an ultrasonic oscillator oscillated to atomize a liquid in the reagent reservoir and uses a fan to externally discharge the atomized liquid from the reagent reservoir to have a patient or the like inhaling the atomized liquid. Atomizers of this type often have two modes, a timer mode using a timer to set a period of time and atomizing a liquid for the set period of time and a continuous mode allowing a liquid to be continuously atomized.

Conventional ultrasonic atomizers as described above in the continuous mode do not have a distinction between active and inactive states. As such the user can hardly determine the current state of the atomizer and thus often believes that it is operating while it actually is not, or vice versa. It is therapeutically not preferable if an atomizer that is believed to be operating is actually not, since the reagent to be introduced through an inhaler for a therapeutical purpose is not introduced. Furthermore, if the atomizer that is not believed to be operating is actually operating, the reagent would be used wastefully or in some case have run out and consequently the atomizer would be driven without the reagent, which is also not preferable to the atomizer.

SUMMARY OF THE INVENTION

Therefore one object of the present invention is to provide an ultrasonic atomizer that can be distinguished between active and inactive states.

The present ultrasonic atomizer has a continuous mode allowing the atomizer to continue to operate until a stop command is entered, wherein the atomizer in the continuous mode provides a first displaying indicating an active state and a second displaying distinguished from the first displaying and indicating an inactive state.

The present ultrasonic atomizer provides the first displaying when the atomizer in the continuous mode has the active state, and the atomizer provides the second displaying, distinguished from the first display, when the atomizer in the continuous mode has the inactive state. By confirming these displayings the user can immediately determine which state the atomizer currently has.

This can prevent the ultrasonic atomizer from providing excessive atomization. Such a disadvantage can also be avoided as failing to provide atomization as the atomizer continues to have the inactive state when atomization is to be provided.

In addition to providing the first displaying, the present ultrasonic atomizer operating in the continuous mode may audibly, periodically notify the user that the atomizer has the active state.

Furthermore it may be adapted to indicate the inactive state in response to having detected an error introduced when the atomizer is operating in the continuous mode.

In addition to indicating the inactive state the atomizer may audibly notify the user that it has the inactive state.

Furthermore the present ultrasonic atomizer may have other than the continuous mode a timer mode deactuating the atomizer when a predetermined period of time has elapsed since its operation started, wherein when an error is introduced in the timer mode, the period of time left is responsively indicated, flashing on and off.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
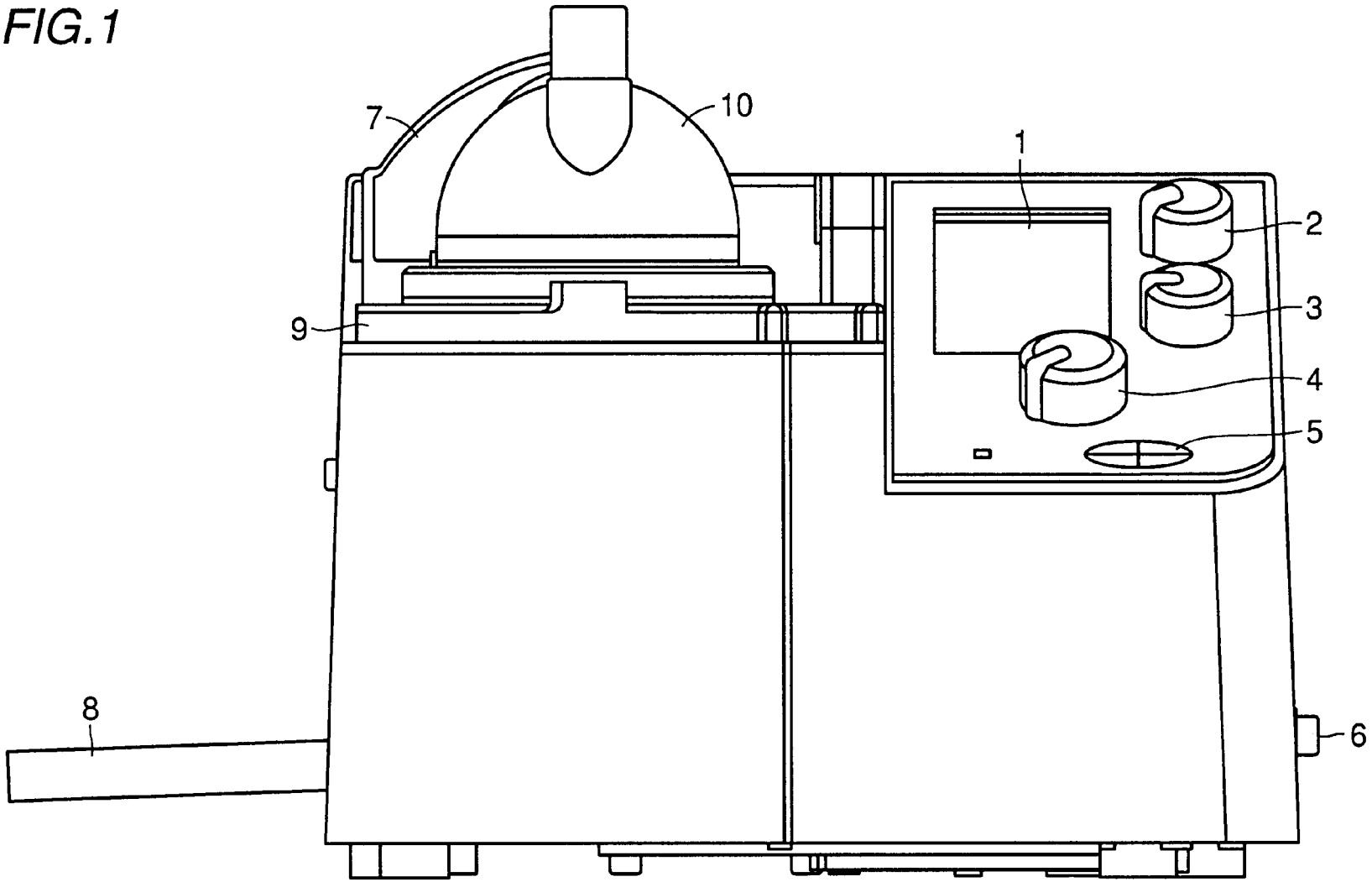
FIG. 1 shows an appearance of an ultrasonic atomizer in one embodiment of the present invention, as seen in its front view.

Hereinafter the present invention will be described in detail with reference to an embodiment. With reference to FIG. 1, the present invention in one embodiment provides an ultrasonic atomizer having a main body with an upper right portion inclining frontward and provided with a display unit 1, an air volume dial 2, an atomization level dial 3, a timer dial 4 and a start/stop switch 5. The main body has a side portion provided with a power supply switch 6. The main body has a left portion provided with an arm 7 fixing a reagent reservoir cover, a discharge hose 8, a reagent reservoir receiver 9 and a reagent reservoir cover 10.

Figure 2:
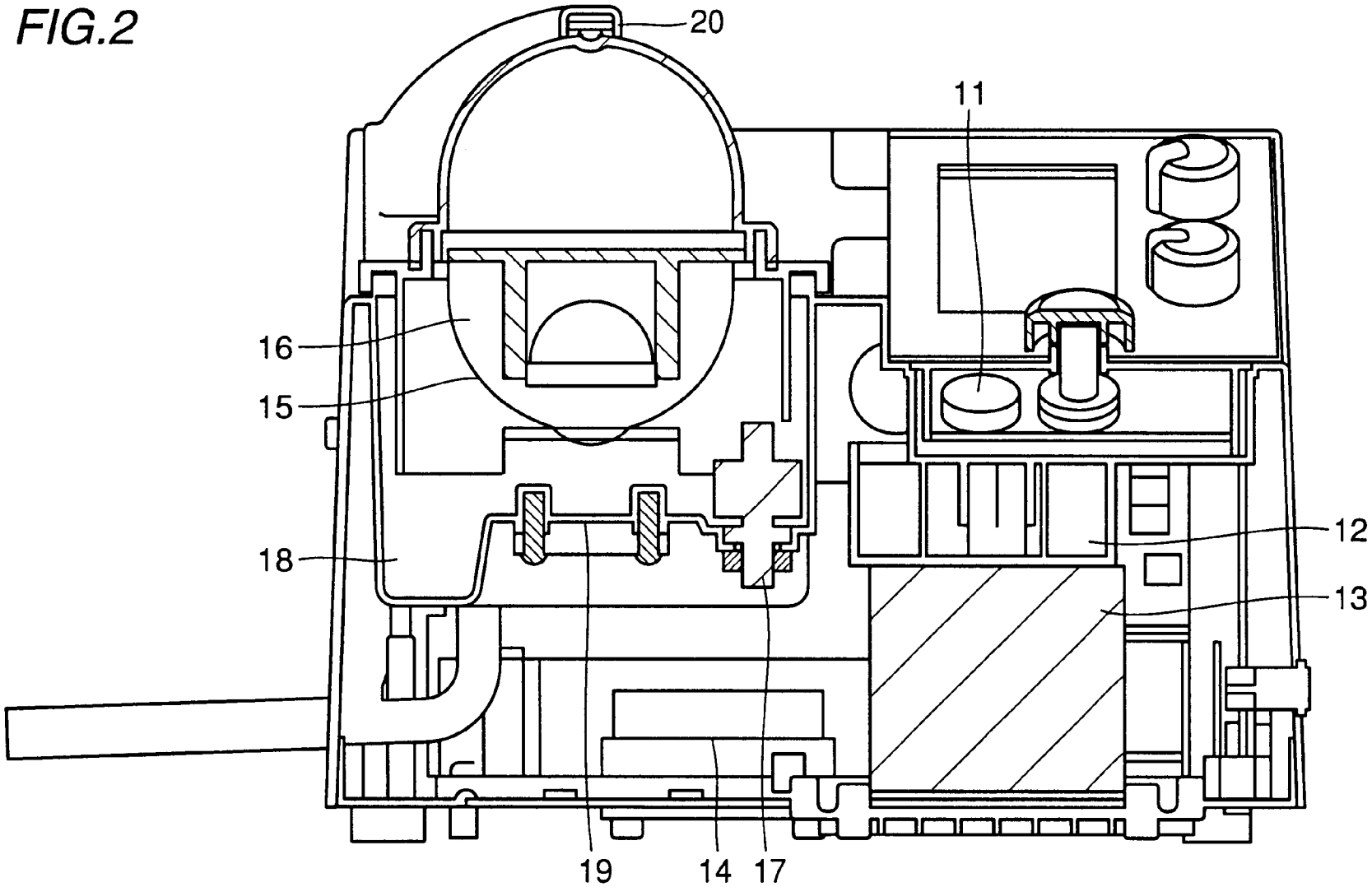
FIG. 2 is a cross section of an ultrasonic atomizer.

FIG. 2 is a cross section internally showing the FIG. 1 ultrasonic atomizer. In the main body of the atomizer are housed a buzzer 11, an oscillation unit 12, a power supply transformer 13, a cooling fan 14, a reagent reservoir 15, a small-capacity atomization kit 16, a float switch 17, a water tank 18, and an oscillator 19. Reservoir cover 10 is fixed by arm 7 at a fixing point 20.

Figure 3:
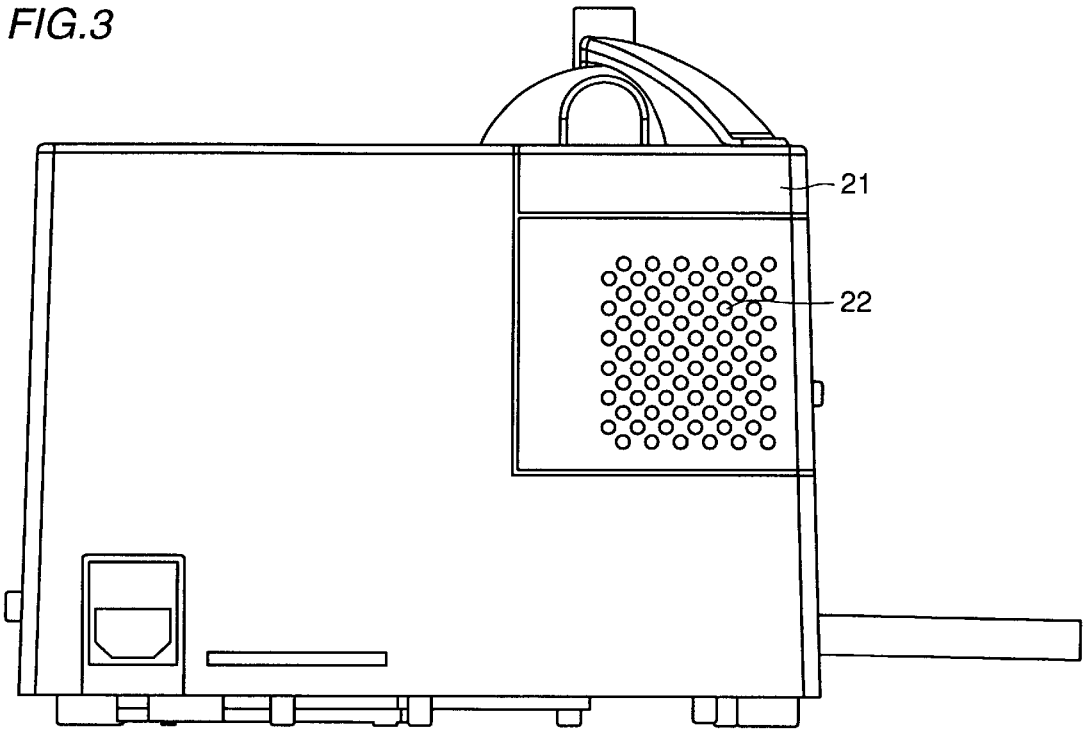
FIG. 3 shows an appearance of an ultrasonic atomizer, as seen in its rear view.
Figure 4:
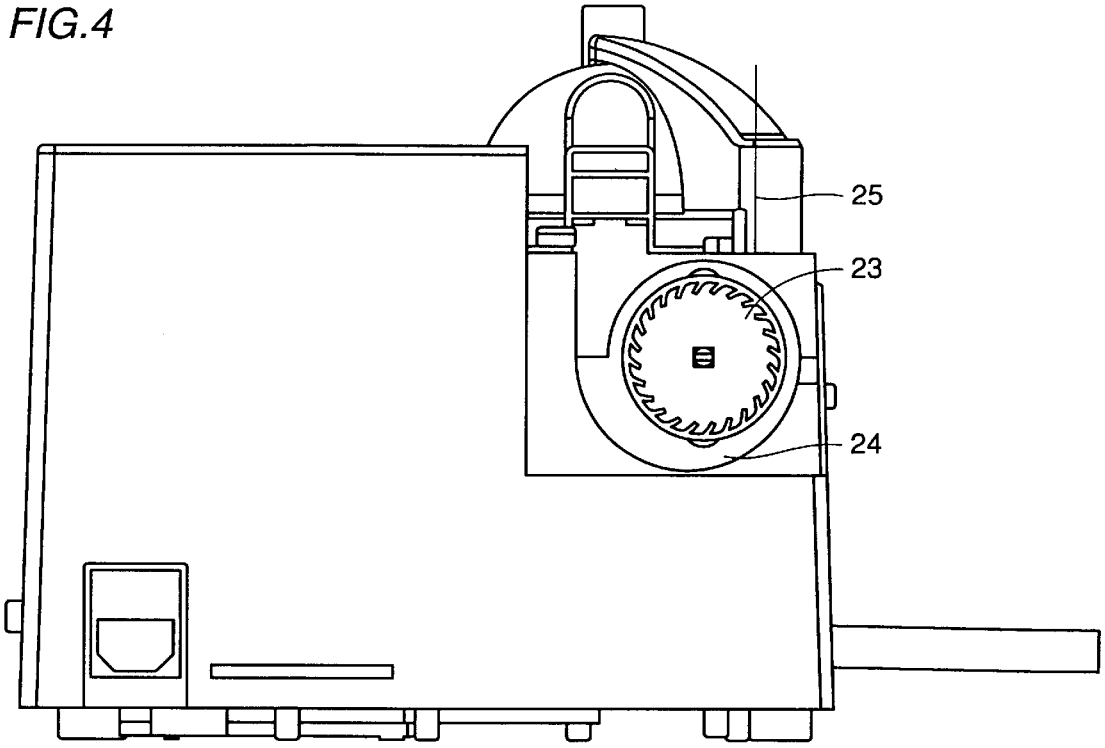
FIG. 4 shows the FIG. 3 atomizer with its fan cover removed therefrom.

FIG. 3 is a rear view of the ultrasonic atomizer. FIG. 4 is the rear view of the atomizer with a fan cover removed therefrom. With reference to FIG. 3, the ultrasonic atomizer includes a fan case 21 and a fan cover 22 and in its rear side includes an air feeding fan 23, an air feeding path 24 and an axis 25 for the arm fixing the reagent reservoir cover.

Figure 5:
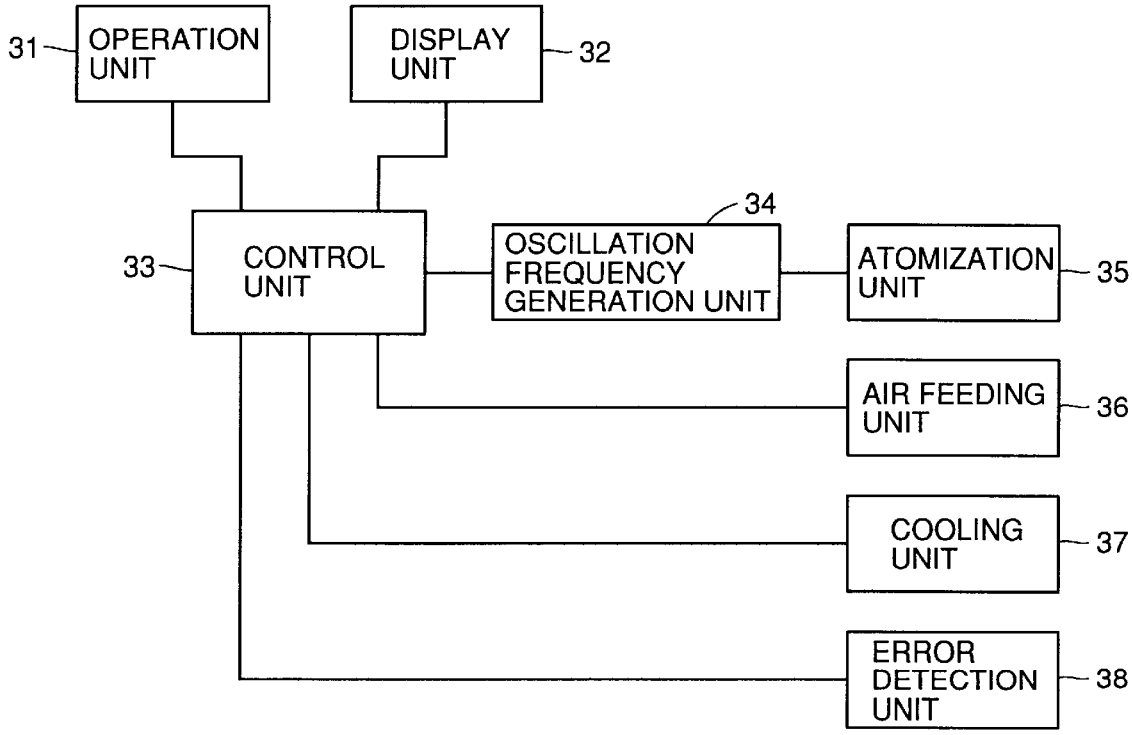
FIG. 5 is a block diagram functionally representing a configuration of an ultrasonic atomizer.

FIG. 5 is a block diagram functionally representing a configuration of the ultrasonic atomizer. The ultrasonic atomizer includes an operation unit 31, a display unit 32, a control unit 33, an oscillation frequency generation unit 34, an atomization unit 35, an air feeding unit 36, a cooling unit 37, and an error detection unit 38.

Operation unit 31 includes air volume dial 2, atomization level dial 3, timer dial 4, start/stop switch 5 and the like. Display unit 32 corresponds to display unit 1 shown in FIG. 1 and it includes a display drive circuit and a display. Control unit 33 is configured mainly of a CPU and it responds to settings of air volume dial 2, atomization level dial 3, timer dial 4 and other components and a signal of error detection unit 38 by transmitting a signal to oscillation frequency generation unit 34, atomization unit 35, air feeding unit 36, cooling unit 37 and display unit 32 to control air volume, atomization level, time for continuous operation, and the like. Oscillation frequency generation unit 34 generates a signal driving oscillator 19 and it corresponds to oscillation unit 12 shown in FIG. 2. Atomization unit 35 includes oscillator 19. Air feeding unit 36 corresponds to air feeding fan 23 including an air feeding motor. Cooling unit 37 corresponds to cooling fan 14 shown in FIG. 2, provided to cool oscillation circuit unit 12. Error detection unit 38 detects such errors as indicating for example that water runs out, the fan cover is improperly attached, and that the reagent reservoir is improperly set.

Figure 6:
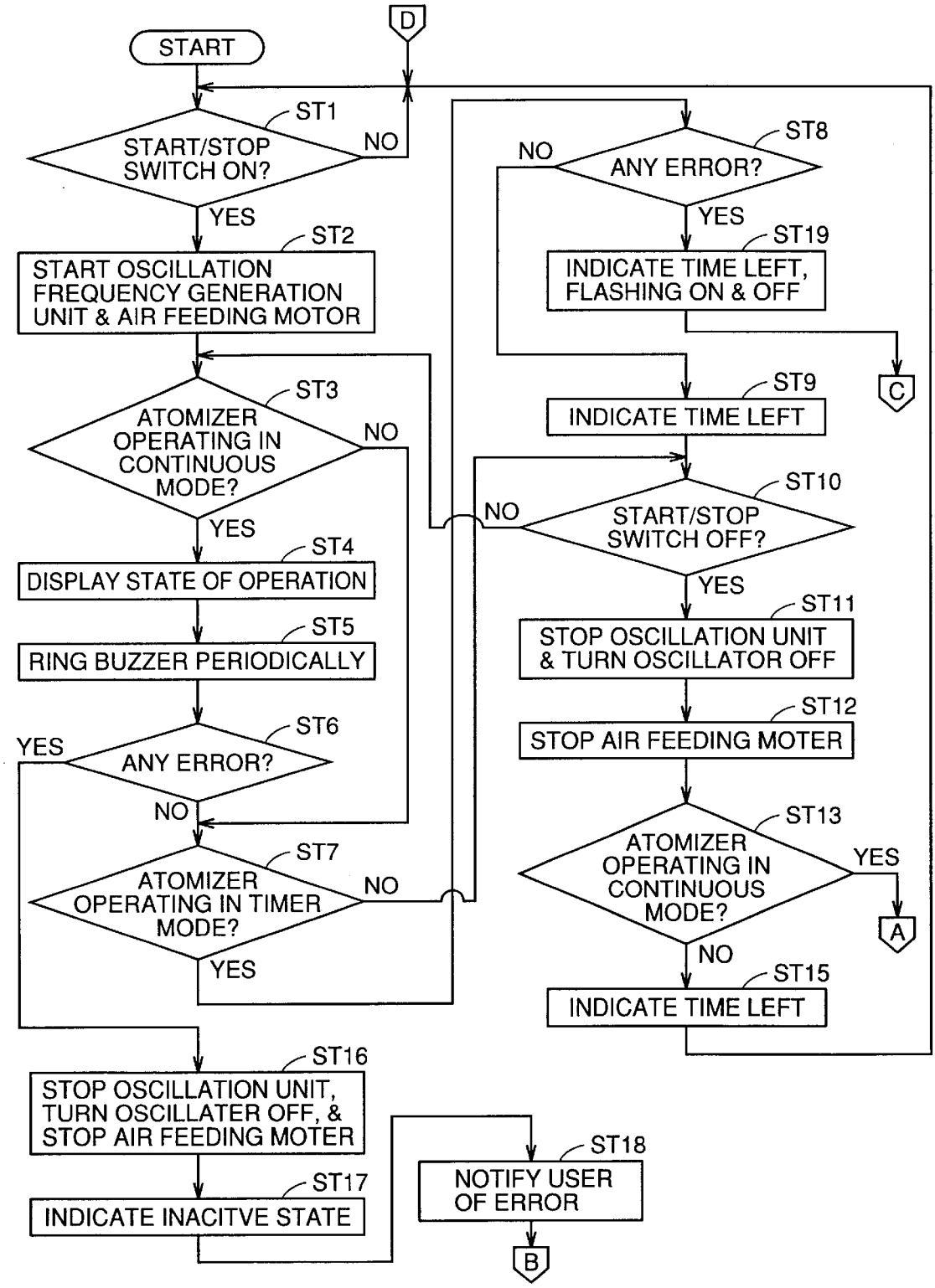
FIGS. 6 and 7 are flow charts for illustrating an operation of an ultrasonic atomizer.
Figure 7:
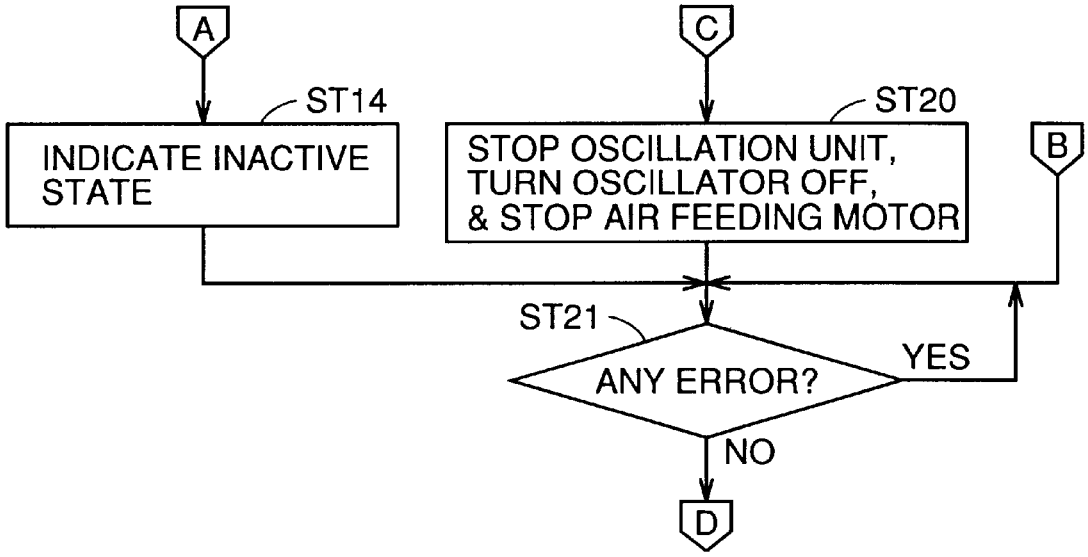
Figure 8A:
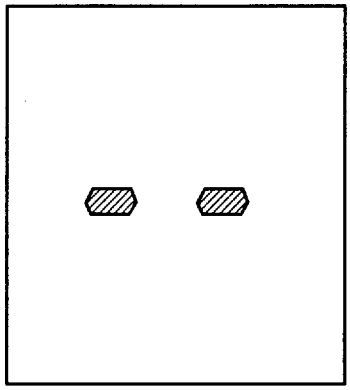
FIGS. 8A–8D show displayings provided by an ultrasonic atomizer operating in a continuous mode.
Figure 8B:
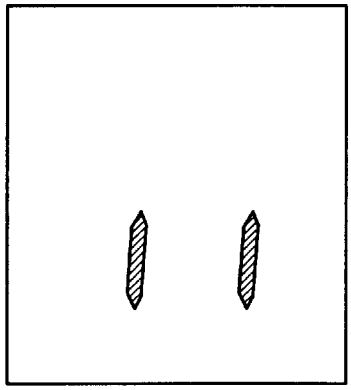
Figure 8C:
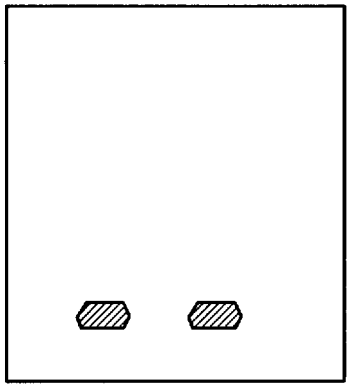
Figure 8D:
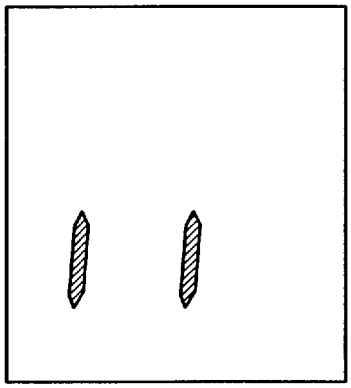

Reference will now be made to the FIGS. 6 and 7 flow charts to describe an operation of the ultrasonic atomizer. Initially, when the power supply switch is turned on the control determines at step ST1 whether start/stop switch 5 has been turned on. If not then the control waits, with the switch as it is, until start/stop switch 5 is turn on. When start/stop switch 5 is turned on the control moves onto step ST2.

At step ST2, oscillation frequency generation unit 34 (oscillation unit 12) and air feeding unit 36 start to operate. Oscillation unit 12 operates and oscillator 19 of atomization unit 35 transmits an ultrasonic wave to the water in water tank 18. The ultrasonic wave is transmitted through the water in water tank 18 to the reagent in reagent reservoir 15. The ultrasonic wave introduces cavitation near a surface of the liquid in reagent reservoir 15 and thus raises the reagent in a fountain to atomize and scatter it. The scattered spray is sent externally together with the air produced by air feeding unit 36.

Following step ST2, the control determines at step ST3 whether timer dial 4 is in the continuous mode. If so then the control moves on to step ST4. If not then the control determines that it is in the timer mode and the control thus moves on to step ST7. At step ST4, display unit 32 indicates an active state, as shown in FIGS. 8A–8D, dynamically, successively moving from one displaying segment to another, starting from FIG. 8A, followed by FIGS. 8B, 8C and 8D, successively, and then going back to FIG. 8A. Observing this dynamic change on the display, a nurse or the like can determine that the atomizer is operating in the continuous mode. Furthermore at step ST5 a buzzer rings periodically. The buzzer can also audibly notify the user that the atomizer is operating in the continuous mode. Step ST5 is followed by step ST6, at which the control determines whether an error has been introduced. The error includes a water-shortage error, a fan-cover error, a reagent-reservoir error, and the like. If such an error has been introduced, the control moves on to step ST16. If not then the control moves on to step ST7, at which the control determines whether the current mode is the timer mode. If timer dial 4 is in the timer mode then the control makes a decision of YES and moves on to step ST8. If at step ST7 the control makes a decision of NO then the control moves on to step ST10.

Steps ST1–ST7 and ST16–ST18 are provided when a state of mode is indicated in the continuous mode and an error is introduced in the continuous mode.

At step ST8, as well as step ST6, the control determines whether an error has been introduced. If not then the control moves on to step ST9. If so then the control moves on to step ST19. At step ST9, free of any errors in the timer mode, display unit 32 indicates the period of time left. Then the control moves on to step ST10. At step ST19 the period of time left is indicated, flashing on and off, and the control moves on to step ST20. Indicating a period of time left flashing on and off can make abnormal atomization more noticeable. At step ST20, oscillation unit 12 stops, oscillator 19 turns off and the air feeding motor also stops. Then the control moves on to step ST21, at which the control determines whether any error has been introduced and if not or if the control determines that the atomizer has recovered then the control goes back to ST1. Steps ST7–ST9 and ST19–ST21 are provided when a state of operation is indicated in the timer mode and an error has been introduced in the timer mode.

At step ST10 the control determines whether start/stop switch 5 has been turned off. If so then the control moves on to step ST11 and if not then it goes back to step ST3. At step ST11 oscillation unit 12 is stopped to stop the oscillation of oscillator 19. Furthermore at the subsequent step ST12 the air feeding motor is stopped. Then the control moves on to step ST13, at which the control determines whether the current mode is the continuous mode. If timer dial 4 is in the continuous mode then the control moves on to step ST14 and if not then the control moves on to step ST15.

Figure 9:
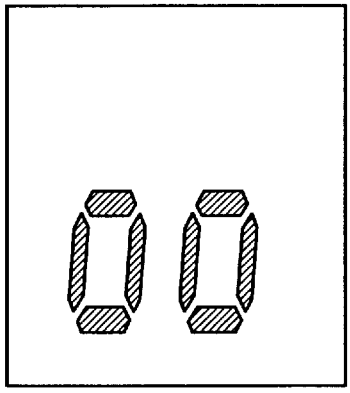
FIG. 9 shows a displaying provided by the ultrasonic atomizer of the same embodiment operating in the continuous mode.

At step ST14 display unit 32 indicates that the atomizer has an inactive state in the continuous mode, such as indicated as "00" shown in FIG. 9. By visually observing this indication on the display, a nurse or the like can determine that the atomizer currently has the inactive state in the continuous mode. Subsequent to step ST14 the control moves on to step ST21, at which the control determines whether any error has been introduced and if not then the control goes back to step ST1. At step ST15, with the atomizer inactive in the timer mode, display unit 32 indicates the period of time left. Steps ST10–ST15 and ST21 are provided when the start/stop switch is turned off in the continuous mode or the timer mode.

At step ST16 the oscillation unit 12 operation is stopped, oscillator 19 is turned off and the air feeding motor is stopped, and the control moves on to step ST17.

At step ST17, with an error introduced in the continuous mode, the FIG. 9 indication is provided to indicate that the atomizer currently has the inactive state. Furthermore the control moves on to step ST18 to notify the user of the introduction of the error for example by indicating the location of the error or audibly notifying the user that the error has been introduced.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ultrasonic atomizer having a continuous mode allowing the atomizer to continue to operate until a stop command is entered, comprising:

a first displaying indicating an active state in said continuous mode; and a second displaying distinguished from said first displaying and indicating an inactive state, wherein said first displaying indicates an active state by repeating a sequence of patterns.

2. The ultrasonic atomizer of claim 1, wherein when the atomizer has the active state in said continuous mode the atomizer audibly, periodically notifies the user accordingly.

3. The ultrasonic atomizer of claim 1, further comprising an error detector detecting an error introduced when the atomizer has the active state in said continuous mode, wherein when said error detector detects said error the atomizer responsively provides said second displaying.

4. The ultrasonic atomizer of claim 3, further comprising, in addition to said second displaying, a notifier audibly notifying a user of the inactive state.

5. The ultrasonic atomizer of claim 3, having other than said continuous mode a timer mode stopping an operation when a predetermined period of time has elapsed since the operation started, said error detector detecting an error introduced in said timer mode, the ultrasonic atomizer further comprising a display operative in response to an error detection by said error detector to indicate a period of time left of said predetermined period of time.

6. An ultrasonic atomizer comprising:

a start switch turned on to start an operation of the atomizer;

a stop switch turned on to stop the operation of the atomizer;

a select switch selecting a mode of operation of the atomizer; and a display indicating a state of operation of the atomizer, wherein said mode of operation includes a mode of continuous operation allowing the operation of the atomizer to continue until said stop switch is turned on to stop the operation of the atomizer, and wherein said display in said mode of said continuous operation employs different displaying forms to indicate whether the atomizer is currently operating, and the display indicates an active state by repeating a sequence of patterns.

7. The atomizer of claim 6, further comprising a buzzer audibly indicating that the atomizer operates in said mode of said continuous operation when the atomizer operates accordingly.

* * * * *